US011305145B2

(12) United States Patent
Bar

(10) Patent No.: US 11,305,145 B2
(45) Date of Patent: Apr. 19, 2022

(54) COMBINED TRAINING AND MONITORING DEVICE

(71) Applicant: HYFIT LTD, Tel Aviv (IL)

(72) Inventor: Guy Bar, Tel Aviv (IL)

(73) Assignee: HYFIT LTD, Tel Aviv (IL)

( * ) Notice: Subject to any disclaimer, the term of this patent is extended or adjusted under 35 U.S.C. 154(b) by 245 days.

(21) Appl. No.: 16/325,418

(22) PCT Filed: Aug. 10, 2017

(86) PCT No.: PCT/IL2017/050891
§ 371 (c)(1),
(2) Date: Feb. 14, 2019

(87) PCT Pub. No.: WO2018/033905
PCT Pub. Date: Feb. 22, 2018

(65) Prior Publication Data

US 2019/0209885 A1 Jul. 11, 2019

Related U.S. Application Data

(60) Provisional application No. 62/374,916, filed on Aug. 15, 2016.

(51) Int. Cl.
*A63B 21/005* (2006.01)
*A63B 21/04* (2006.01)
(Continued)

(52) U.S. Cl.
CPC .... *A63B 21/0442* (2013.01); *A63B 21/00069* (2013.01); *A63B 21/02* (2013.01);
(Continued)

(58) Field of Classification Search
CPC ..... A63B 2225/50; A63B 21/0552; A63B 24/0087; A63B 2024/0093; A63B 21/4043; A63B 24/0062; A63B 2220/17; A63B 2225/20; A63B 21/005; A63B 21/4025; A63B 2220/833; A63B 2225/09; A63B 2220/80; A63B 2220/836; A63B 21/018; A61H 2201/165; A61H 2201/0192; A61H 2201/501; A61H 2201/5058;
(Continued)

(56) References Cited

U.S. PATENT DOCUMENTS 6,540,649 B1 4/2003 Niedrich
9,149,223 B2 10/2015 Spears et al.
(Continued)

OTHER PUBLICATIONS

International Search Report for PCT/IL2017/050891, dated Nov. 6, 2017, 3 pages.
(Continued)

*Primary Examiner* — Deborah L Malamud
(74) *Attorney, Agent, or Firm* — Fox Rothschild LLP

(57) ABSTRACT

The present invention relates to a body resistance physical exercise device with monitoring and fitness tracking ties comprising: a) an electrical monitoring element configured to measure information relative to exercise parameters during repetitive motions performed with said device; and b) an elastomeric band adapted to enable the repetitive motions, wherein the resistance of the elastomeric band is capable of being adjusted.

12 Claims, 11 Drawing Sheets

(51) Int. Cl.

| | |
|---|---|
| ***A63B 21/055*** | (2006.01) |
| ***A63B 21/02*** | (2006.01) |
| ***A63B 21/00*** | (2006.01) |
| ***A63B 21/16*** | (2006.01) |
| ***A63B 23/035*** | (2006.01) |
| ***A63B 24/00*** | (2006.01) |

(52) U.S. Cl.
CPC ..... *A63B 21/0552* (2013.01); *A63B 21/1618* (2013.01); *A63B 21/4013* (2015.10); *A63B 21/4021* (2015.10); *A63B 21/4035* (2015.10); *A63B 23/0355* (2013.01); *A63B 24/0062* (2013.01); *A63B 2220/17* (2013.01); *A63B 2220/803* (2013.01); *A63B 2225/09* (2013.01); *A63B 2225/50* (2013.01); *A63B 2230/06* (2013.01); *A63B 2230/50* (2013.01); *A63B 2230/75* (2013.01)

(58) Field of Classification Search
CPC ..... A61B 2562/0219; A61B 5/6804; A61B 2505/09; A61B 5/222; A61B 5/6831; A61B 5/486; A61B 2562/227; A41D 1/002; A61N 1/0476; A61N 1/0484; A61N 1/321; G06F 1/163
See application file for complete search history.

(56) References Cited

U.S. PATENT DOCUMENTS

| | | | | |
|---|---|---|---|---|
| 2010/0317495 | A1 | 12/2010 | DiGiovanni et al. | |
| 2014/0142864 | A1* | 5/2014 | Spears | A61B 5/1112 702/19 |
| 2015/0258362 | A1 | 9/2015 | Cornish | |

OTHER PUBLICATIONS

Written Opinion of the International Searching Authority for PCT/IL2017/050891, dated Nov. 6, 2017, 5 pages.

* cited by examiner

COMBINED TRAINING AND MONITORING DEVICE

FIELD OF THE INVENTION

The present invention relates to the field of physical exercise devices. More particularly, the invention relates to a physical exercise device that is capable to monitor training activity.

BACKGROUND OF THE INVENTION

Several body resistance physical exercise devices are currently available on the market. In some cases these devices are based on the use of an elastomeric band, one or both sides of which is configured to be attached to the arms, hands or legs of an exerciser in order to exercise using the elastomeric band. Typically such an exercise comprises stressing and releasing the elastomeric band in repetitive motions, thereby straining and releasing muscles that are used to perform the band stressing.

In order to most efficiently workout using a body resistance elastomeric band, it should be adjusted to suit the dimensions of the exerciser and the exerciser's desired resistance. Several known devices provide an adjustment apparatus for adjusting the length of the exercise strap. These apparatus are usually not straight forward and require time, expertise and strength in order to adjust the resistance of the strap.

Furthermore, many body resistance devices comprise a handle that is required to be held firmly by an exerciser during arm muscles exercise. Although muscles that are used for obtaining a strong grip sometimes need to be strengthened, this is not always a goal of an exerciser, and therefore requiring one to put in effort merely to hold on to the handle is a waste of the exerciser's strength that could otherwise be put into exercising the desired muscles.

In addition, several monitoring and tracking devices exist in the field of physical training, which provide information regarding an exercise, e.g. number of iterations, amount of burnt calories, etc. Other types of monitoring devices measure an exerciser's body signs (e.g. heart and respiratory rates, body temperature etc.) and provide data based thereon. Many of these monitoring devices aren't integrated into one single exercising device, and therefore an exerciser is obligated to purchase and use a plurality of devices in order to monitor an exercise in all aspects. This is obviously both expensive and inconvenient.

It is therefore an object of the present invention to provide a physical exercise resistance device that comprises electronics and an elastomeric band, and which is capable of measuring exercise parameters that may include heart rate, calories burned, iterations and strength exerted on the elastomeric band, and wherein the resistance of the band is capable of being easily adjusted.

It is another object of the present invention to provide a physical exercise device that is not required to be held in the hand of an exerciser during arm muscles exercises.

It is yet another object of the present invention to provide a physical exercise device with integrated monitoring and tracking capabilities.

Other objects and advantages of this invention will become apparent as the description proceeds.

SUMMARY OF THE INVENTION

The present invention relates to a body resistance physical exercise device with monitoring and fitness tracking capabilities, comprising:

a. an electrical monitoring element configured to measure information relative to exercise parameters during repetitive motions performed with said device; and b. an elastomeric band adapted to enable the repetitive motions, wherein the resistance of the elastomeric band is capable of being adjusted.

According to an embodiment of the invention, the electrical monitoring element comprises one or more sensors suitable to measure user/exerciser parameters such as heart rate, respiration rate, calories burnt, etc.

According to an embodiment of the invention, the electrical monitoring element comprises one or more sensors suitable to measure exercise parameters such as iterations, strength exerted on the elastomeric band and the like. The one or more sensors can be accelerometer, gyroscope, thermometer, etc.

According to an embodiment of the invention, electrical monitoring element comprises a transmitting element for wirelessly transmitting the measured information to a remote device (e.g., via Bluetooth or other suitable wireless communication methods);

According to an embodiment of the invention, the body resistance physical exercise device comprises:

a) an anchoring arrangement adapted for attaching a first end of the elastomeric band to an anchor;

b) a handle section for attaching a second end of said elastomeric band to a user, the handle section comprising the electrical monitoring element and a band reverting element; and c) an adjusting apparatus for adjusting the resistance and length between said anchoring arrangement and said handle section;

wherein the length of said elastomeric band runs from its first end that is fixedly attached to the anchoring arrangement, through said adjusting apparatus, along said band reverting element and back to said adjusting apparatus to which the second end thereof is fixedly attached, thereby providing an exercise device with monitoring and fitness tracking capabilities.

According to an embodiment of the invention, the anchoring arrangement comprises an anchoring portion to which the first end of the elastomeric band is connected; and a connection portion for connecting the anchoring arrangement to an object.

According to another embodiment of the invention, the handle section further comprises a bracelet belt for connecting the handle section to a body part, and a mediating element connecting the band reverting element to the bracelet belt.

According to still another embodiment of the invention, the electrical monitoring element comprises a rechargeable power source; a processing unit; and a user interface unit for receiving local input and displaying information regarding measured information and other information.

According to an embodiment of the invention, the adjusting apparatus comprises:

A. an opening in the wall of a first side of the adjusting apparatus;

B. two openings in the wall of a second side of the adjusting apparatus, the second side opposite to the first side, a first one of the two openings parallel to the opening in the wall of the first side of the adjusting apparatus;

C. a locking apparatus comprising a moveable member, a stationary member, a spring and an actuator;

wherein a portion of the elastomeric band passes through the opening in the wall of the first side, between the moveable and stationary members, and through the first one of the two openings, such that when the actuator is released the moveable member is forced towards the stationary member by the spring thereby locking the elastomeric band in place, and such that when the actuator is pressed upon the moveable member is forced away from the stationary member and the elastomeric band is unlocked; and wherein the second end of the elastomeric band passes through the second opening in the wall of the second side, and is fixedly attached thereto.

DETAILED DESCRIPTION OF THE INVENTION

Reference will now be made to an embodiment of the present invention, examples of which are illustrated in the accompanying figures for purposes of illustration only. One skilled in the art will readily recognize from the following description that alternative embodiments of the structures and methods illustrated herein may be employed, mutatis mutandis, without departing from the principles of the claimed invention.

Figure 1A:
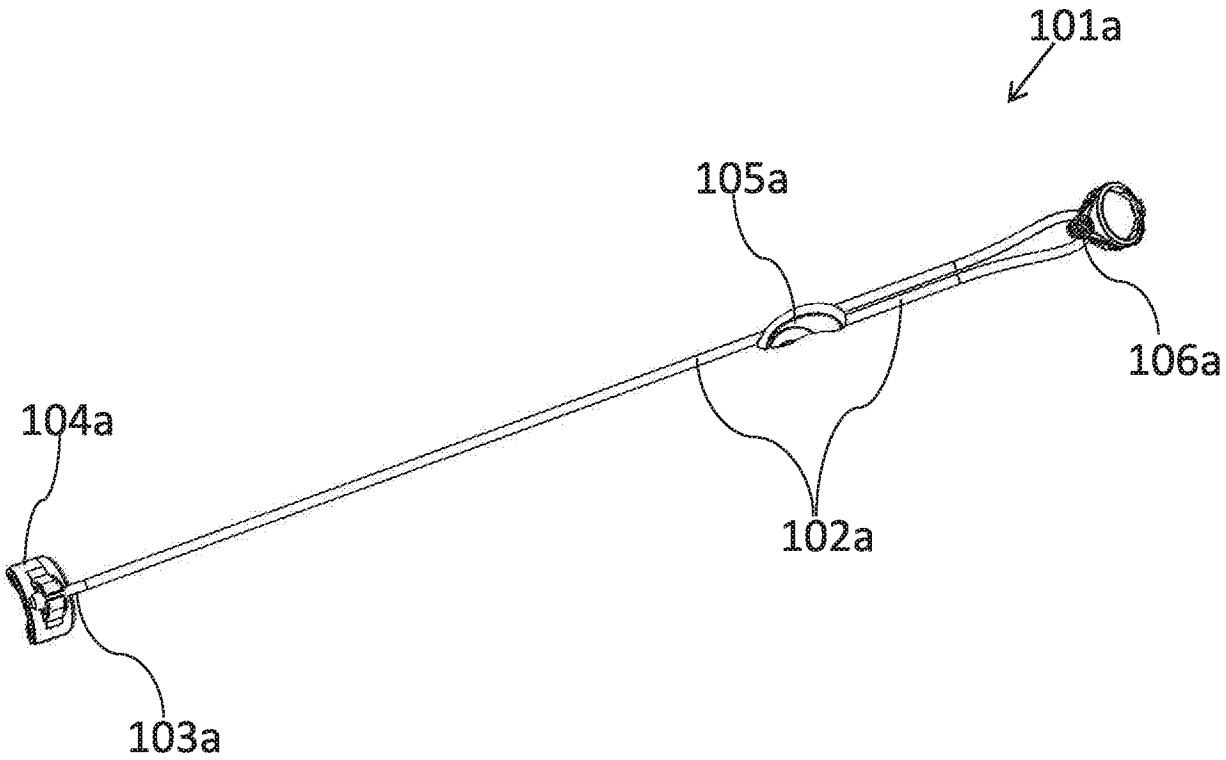
FIG. 1A is a perspective view of a body resistance physical exercise device according to an embodiment of the present invention.
Figure 1B:
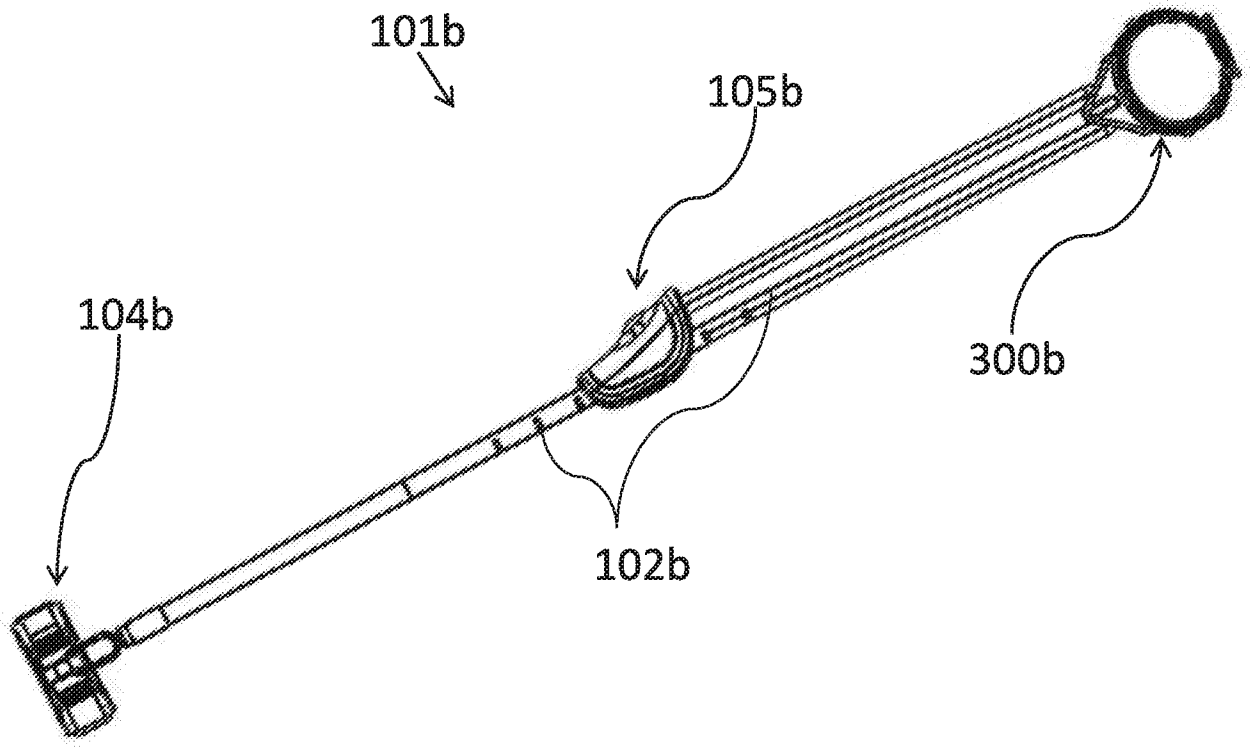
FIG. 1B is a perspective view of a body resistance physical exercise device according to another embodiment of the present invention.

FIG. 1A schematically illustrates a body resistance physical exercise device 101*a* according to an embodiment of the present invention. The device of the present invention comprises an elongated elastomeric band 102*a* the first end of which 103*a* is fixedly attached to an anchoring arrangement 104*a* for attaching the first end 103*a* to an anchor. The elastomeric band length passes through an adjusting apparatus 105*a*, along a band reverting element 106*a*, and finally ends up with its second end (not shown in FIG. 1A) fixedly attached to adjusting apparatus 105*a*. FIG. 1B is a perspective view of a body resistance physical exercise device 101*b* according to another embodiment of the present invention.

According to an embodiment of the invention, bands 102*a* and 102*b* comprise an elastomeric material suitable to be stretchable and present resistance when stretched, with a length of about 135 cm long, and a circular cross-section with a diameter of between 1 and 2 cm.

Figure 2A:
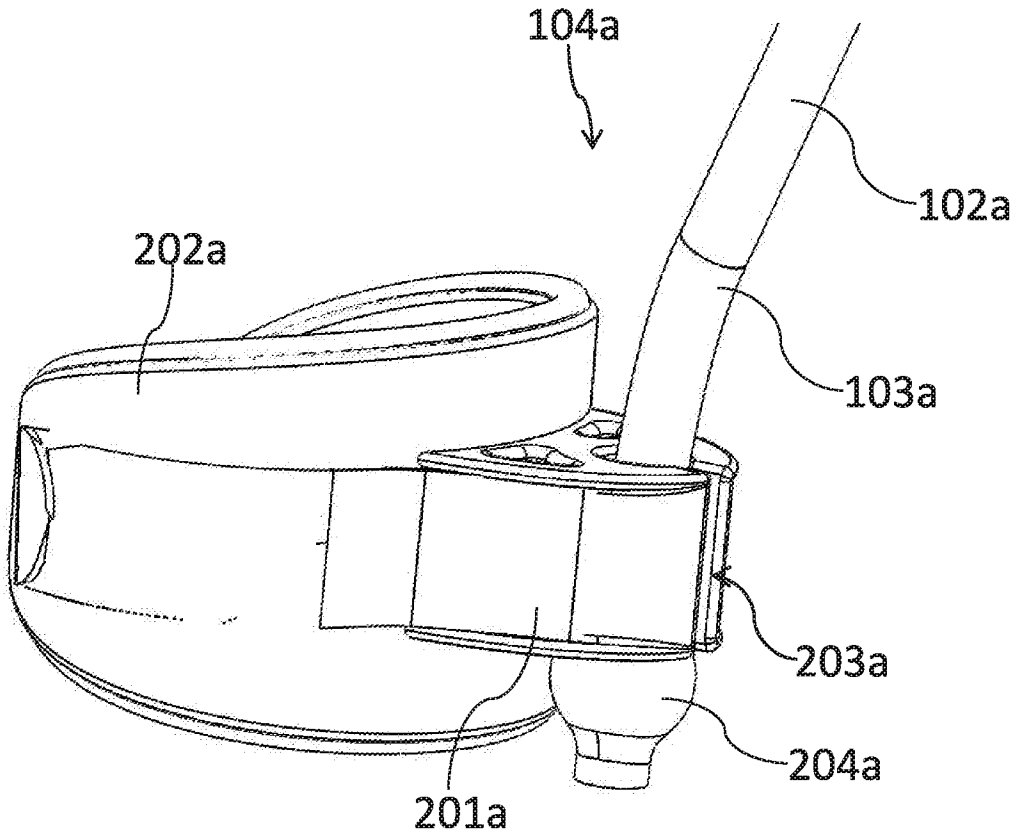
FIG. 2A shows an enlarged perspective view of an anchoring arrangement of the device of FIG. 1A.

FIG. 2A schematically illustrates an enlarged view of anchoring arrangement 104*a* and the first end 103*a* of the elastomeric band 102*a* attached thereto, according to an embodiment of the invention. Anchoring arrangement 104*a* comprises an anchoring portion 201*a* and a connection portion 202*a*. Band 102*a* passes through opening 203*a* in anchoring portion 201*a*, and is terminated at a restricting element 204*a* that is not capable of passing through openings 203*a*. Restricting element 204*a* can either part of band 102*a* (such as a knot) or otherwise an element external to the elastomeric band to which first end 103*a* is fixedly attached. The connection portion 202*a* comprises an adjustable belt configured to accommodate an anchor (not shown in FIG. 2A) such that strength exerted upon band 102*a* will be definitely counterforced. For example, connection portion 202*a* can be connected to an exerciser's ankle, wrist or other body part, or otherwise to an external anchor such as a pole, tree, bar, door or an external connecting apparatus.

Figure 2B:
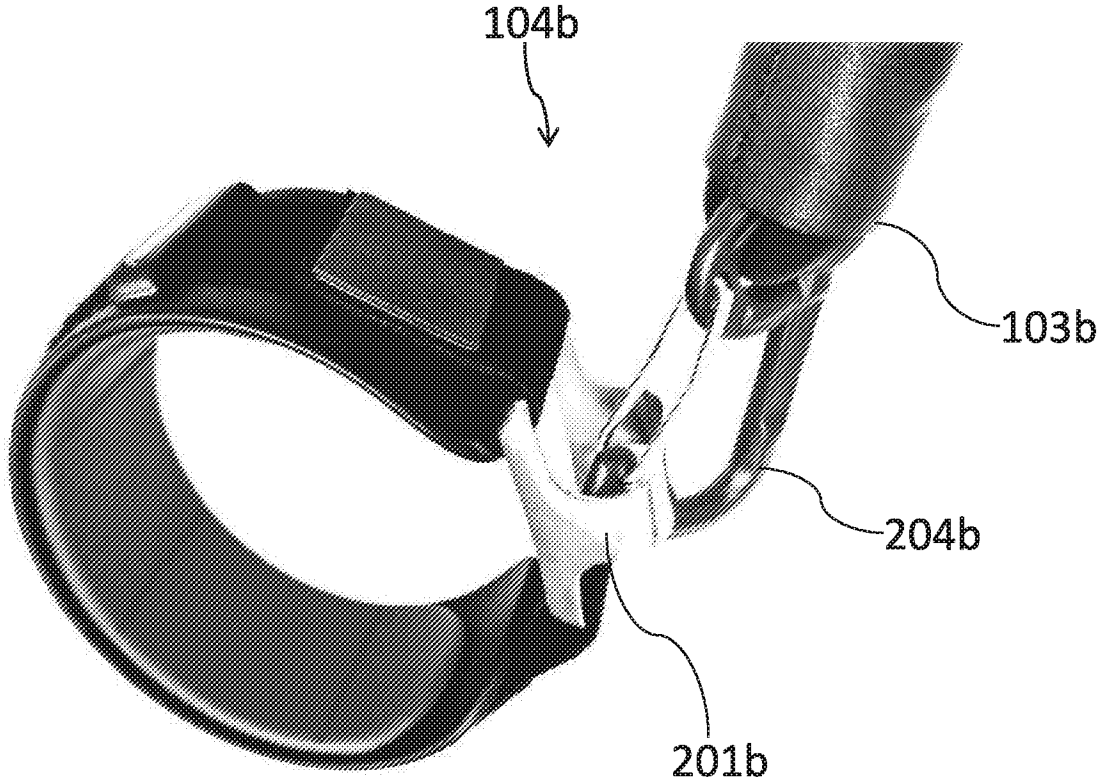
FIG. 2B shows an enlarged perspective view of an anchoring arrangement of the device of FIG. 1B.

FIG. 2B schematically illustrates an enlarged view of anchoring arrangement 104*b* and the first end 103*b* of the elastomeric band attached thereto, according to another embodiment of the invention. First end 103*b* is fixedly attached to clipping element 204*b* that is configured to be reversibly clipped to anchoring portion 201*b*.

Figure 3A:
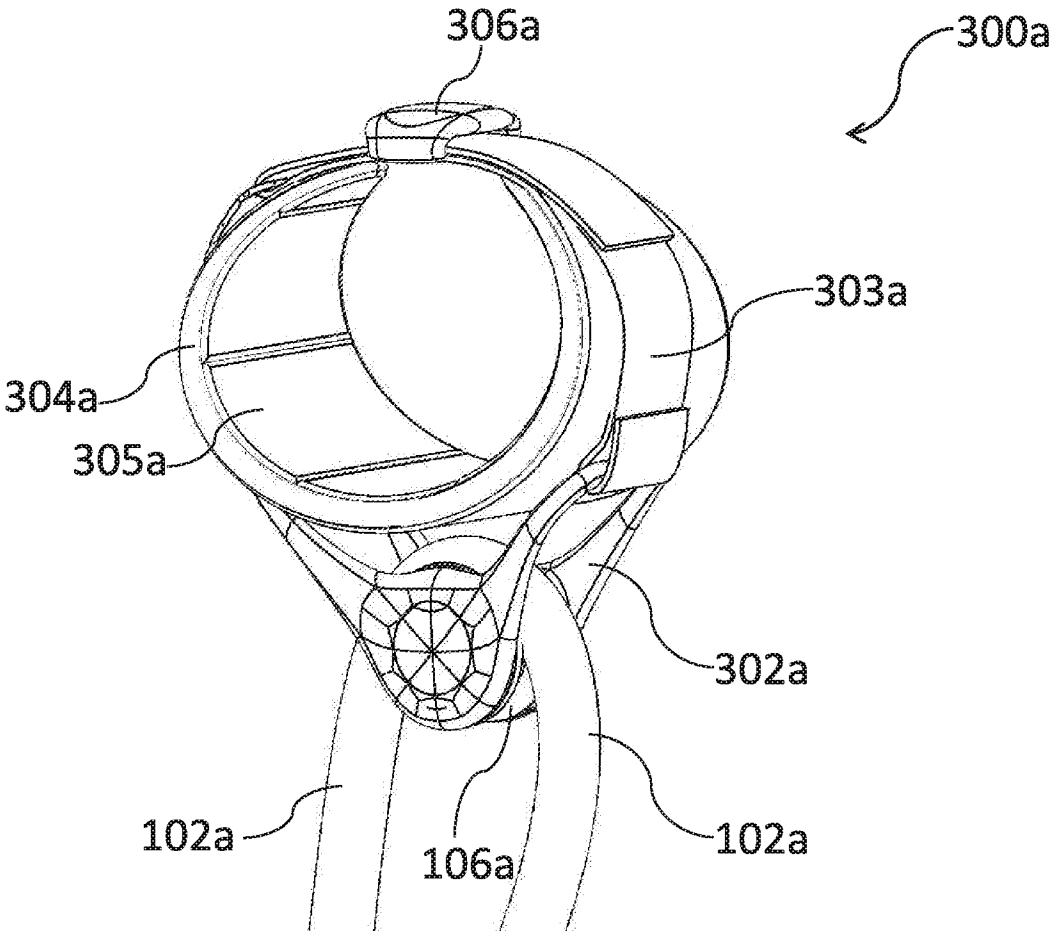
FIG. 3A shows an enlarged perspective view of a handle section of the device of FIG. 1A.

FIG. 3A schematically illustrates an enlarged view of a handle section 300*a* of device 101*a*, according to an embodiment of the invention. Mediating element 302*a* is attached to each side of a bracelet belt 301*a* and to band reverting element 106*a*, such that band reverting element 106*a* is connected to belt 301*a*. Band reverting element 106*a* comprises a pulley around which band 102*a* passes, such that band 102*a* is connected via band reverting element 106*a* and mediating element 302*a* to bracelet belt 301*a* and ultimately to the handle section 300*a* of device 101*a*.

Acknowledging that bracelet belt 301 and mediating element 302 are the elements with which an exerciser comes in contact most during an exercise and upon which the exerciser exerts most strength, according to an embodiment of the invention a cuff 304 is provided in the space opened between mediating element 302 and bracelet belt 301, such that element 302 doesn't encounter the body part of an exerciser using the handle section 300. Cuff 304 is provided with a rigid core surface (not shown in the Figs.) that is padded and covered by an anti-sweat fabric layer 305 for durable and comfortable use of the exercise device 101.

According to an embodiment of the invention, cuff 304 is partially closed circular shaped, whereas its partially opened space 304*a* allows contact between a body part of the exerciser (e.g. the exerciser's wrist) and the bracelet belt 301. In some embodiments, electronic monitoring element 306 is connected to belt 301 in a position corresponding to the partially opened space 304*a*, thereby allowing contact with an exerciser's body part (e.g. wrist).

Monitoring element 306 comprises one or more sensors (e.g. accelerometer, gyroscope, thermometer, etc.) suitable to measure exercise parameter (e.g. iterations, strength exerted on band 102, etc.) and exerciser parameters (such as heart and respiration rates, calories burnt, etc.). Monitoring element 306 further comprises a transmitting element suitable to wirelessly transmit measured information to a remote device (e.g. via Bluetooth communication) where the information can be processed for further reference, such as providing exercise recommendations to an exerciser based on a previous exercise. Monitoring element 306 further comprises a power source (e.g. a rechargeable battery) that can be recharged (e.g. via a micro-USB cable) or replaced (e.g. button cell batteries).

According to an embodiment of the invention, monitoring element 306 further comprises a processing and user interface unit, configured to receive local input by physical contact (e.g. pressing a button or icon) or by voice recognition (e.g. being/end measuring exercise) and to locally display information regarding an exercise (e.g. heart rate and/or number of iterations) or other information (e.g. the time of the day).

Figure 3B:
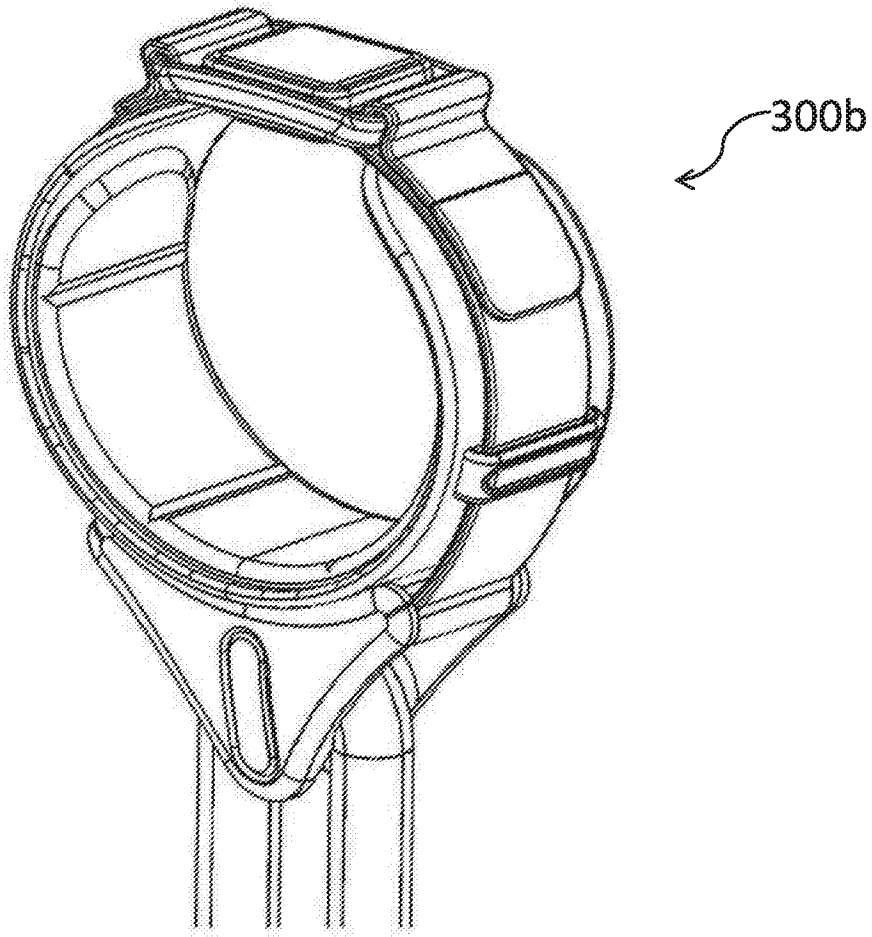
FIG. 3B shows an enlarged perspective view of a handle section of the device of FIG. 1B.

FIG. 3B schematically illustrates an enlarged view of a handle section 300*b* of device 101*b*, according to an embodiment of the invention.

Figure 4A:
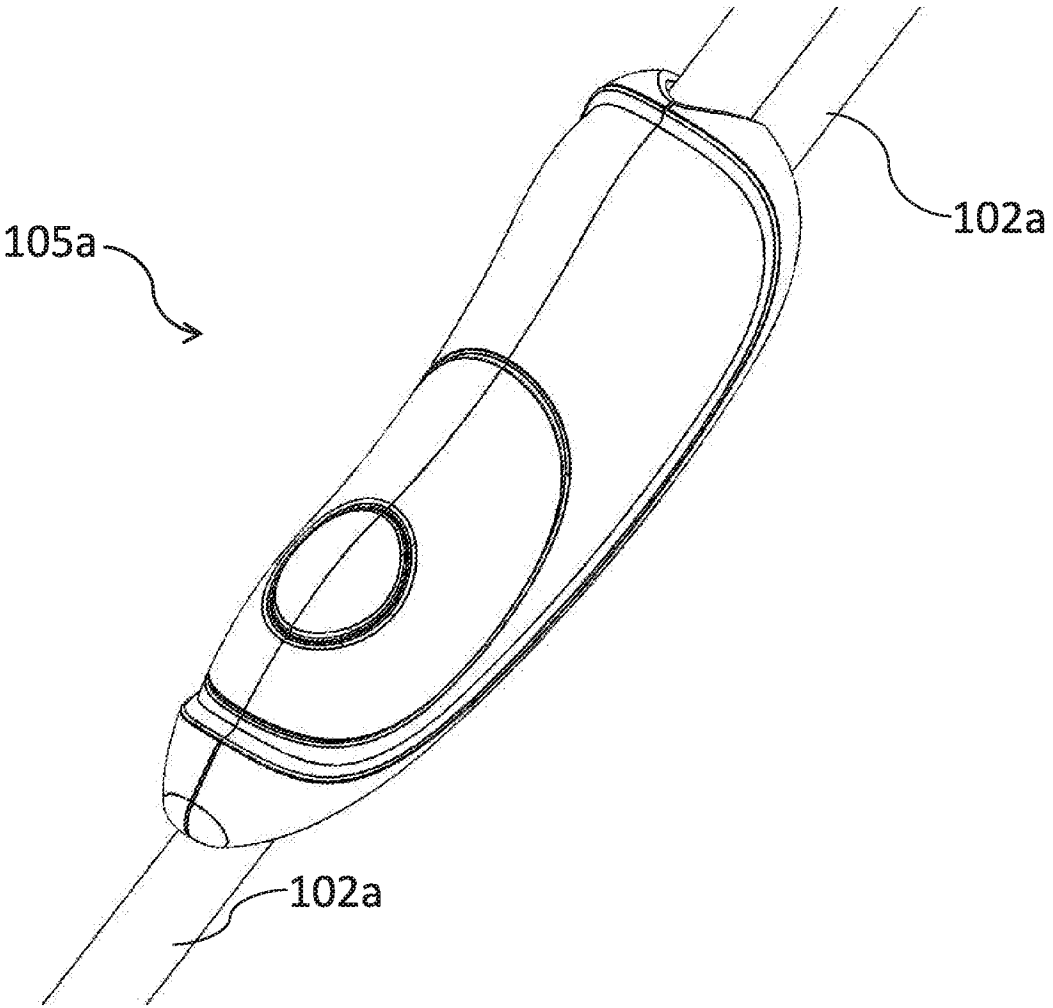
FIG. 4A shows an enlarged perspective view of an adjusting apparatus of the device of FIG. 1A.
Figure 4B:
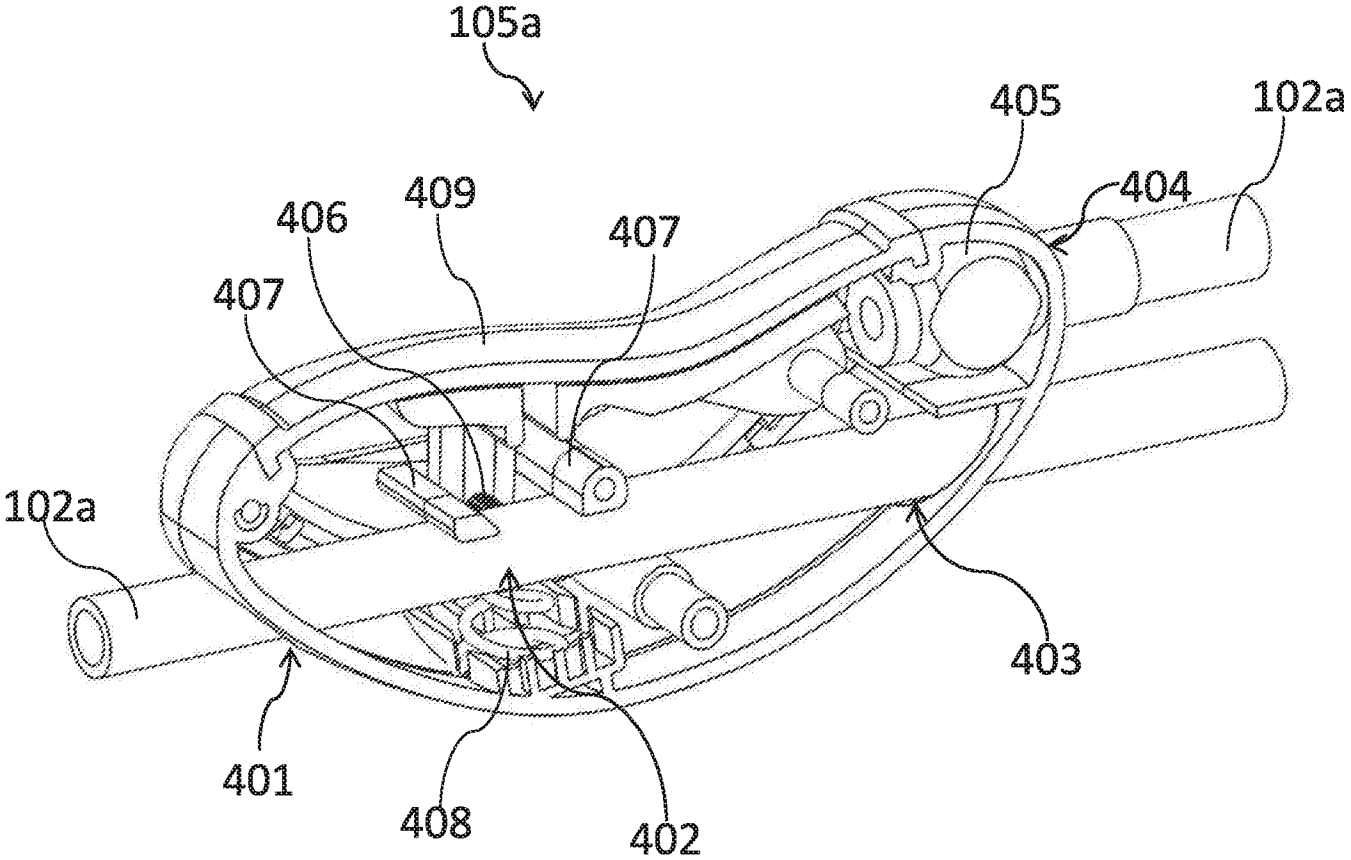
FIG. 4B schematically illustrates the adjusting apparatus of FIG. 4A, in a first position according to an embodiment of the invention.

FIG. 4A is an enlarged perspective view of adjusting apparatus 105*a* of FIG. 1A. FIG. 4B schematically illustrates an enlarged cutaway view of adjusting apparatus 105*a* in a first position, according to an embodiment of the invention. A portion of band 102*a* passes through an opening 401 in the wall of a first side of adjusting apparatus 105*a*, through a locking apparatus 402 and through an opening 403 in a second side of adjusting apparatus 105*a* opposite to the first side. Another portion of band 102*a* passes through another opening 404 in the second side of adjusting apparatus 105*a*. The second end of band 102*a* is terminated at a restricting element 405 that is not capable of passing through opening 403. Restricting element 405 can either part of band 102*a* (such as a knot) or otherwise an element external to the elastomeric band to which the second side of band 102*a* is fixedly attached.

Locking apparatus 402 comprises a moveable member 406, a stationary member 407, a spring 408 and an actuator 409. Band 102*a* passes between the moveable and stationary members. When actuator 408 is pressed upon, spring 407 obtains a compressed position (as shown in FIG. 4B), moveable member 405 is forced away from stationary member 406 and band 102 is unlocked and released. This configuration is suitable for shifting the adjusting apparatus to another position along band 102*a* for adjusting the resistance and length of device 101*a*.

Figure 4C:
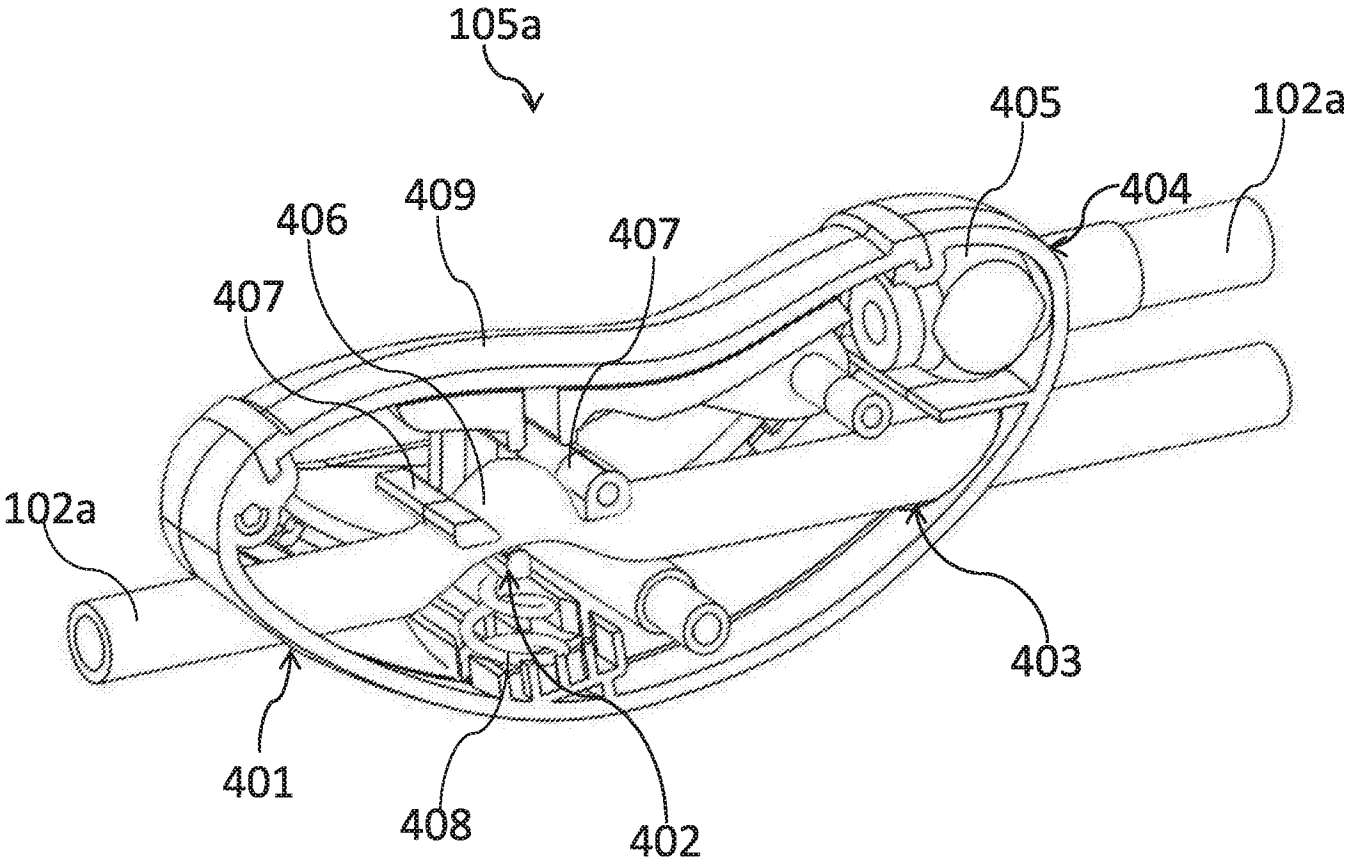
FIG. 4C schematically illustrates the adjusting apparatus of FIG. 4A, in a second position according to another embodiment of the invention.

FIG. 4C schematically illustrates an enlarged cutaway view of adjusting apparatus 105*a* in a second position, according to another embodiment of the invention. When actuator 409 is released, spring 408 obtains a resting position (as shown in FIG. 4C), moveable member 406 is forced by spring 408 towards stationary member 407, and band 102*a* is pressed between members 406 and 407 and is therefore locked therebetween. This configuration is suitable for locking adjusting apparatus 105*a* in place (relative to band 102*a*) whenever there isn't need for adjusting the resistance in the band, for instance in order to keep a constant resistance level and length.

Figure 4D:
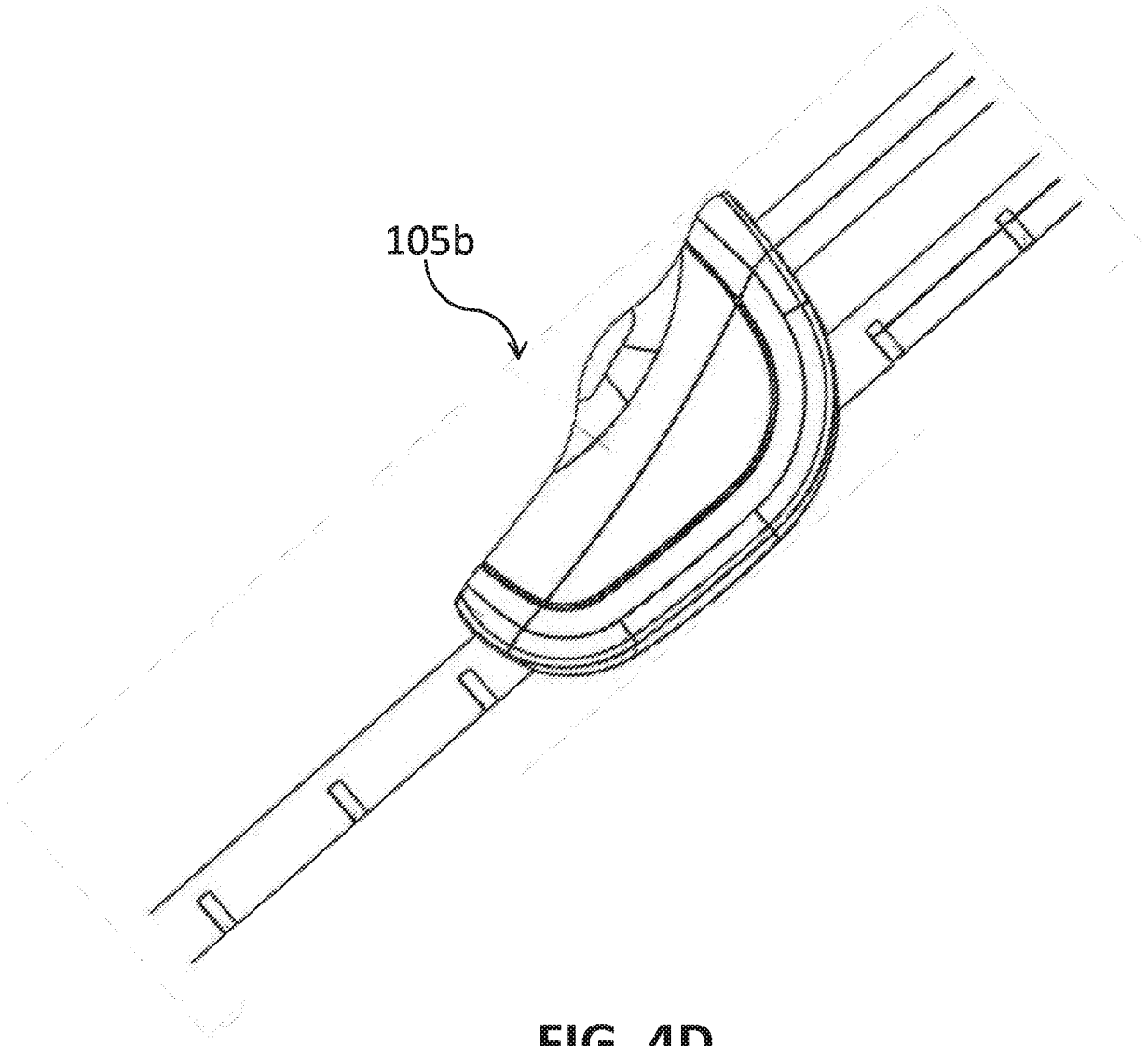
FIG. 4D shows an enlarged perspective view of an adjusting apparatus of the device of FIG. 1B.

FIG. 4D is an enlarged perspective view of adjusting apparatus 105*b* of FIG. 1B according to an embodiment of the invention.

According to an embodiment of the invention, the transmitting elements of the electronic monitoring element (306 in FIG. 3) are associated with a software application (app) for mobile devices, the app capable of utilizing processing capabilities and other features of mobile devices in order to enhance the information an exerciser may receive regarding an exercise. For instance, the app can be synchronized and interface with other software applications (such as a calendar, medical data or diet management) so as to automatically input exercise information for following an exerciser's physical status and for providing the exerciser workout recommendations based on data from the other applications.

Figure 5:
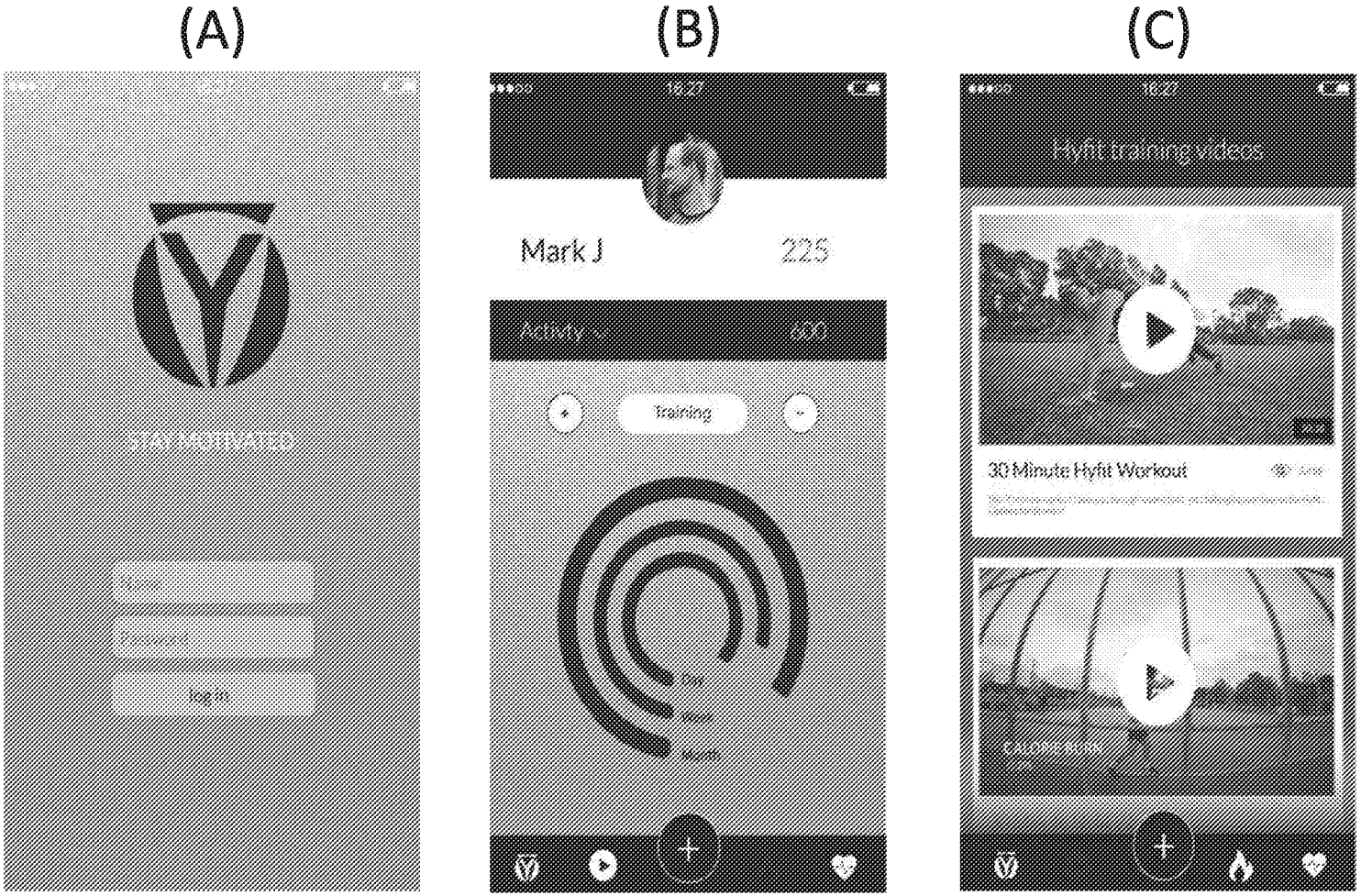
FIGS. 5(A-C) schematically illustrate screenshots of a software application, according to an embodiment of the invention.

FIGS. 5A, 5B and 5C each schematically illustrate a screenshot displayed on the screen of a mobile device running the app, according to an embodiment of the invention. The screenshot of FIG. 5A shows a login screen to which a user (e.g. an exerciser) is required to input a Name and Password in order to login to the app services. The screenshot of FIG. 5B shows a training history display. The screenshot of FIG. 5C shows instructional videos that a user can watch in order to enhance an exercise and learn efficient methods to use the device 101.

Since some exercisers may wish to use an external anchor (e.g. a tree or a door) to which anchoring arrangement 104 cannot be attached, anchoring arrangement 104 can be attached to an anchoring connector that is capable of being connected to external anchors, such as a connector fixed to an elongated strap suitable to surround objects or fixed to a door anchor apparatus suitable to be anchored between a door and its jamb.

Although embodiments of the invention have been described by way of illustration, it will be understood that the invention may be carried out with many variations, modifications, and adaptations, without exceeding the scope of the claims.

The invention claimed is:

1. A body resistance physical exercise device, comprising:

a) an electrical monitoring element configured to measure information relative to exercise parameters during repetitive motions performed with said device;

b) an elastomeric band configured to stretch when subjected to a user-generated force resulting from the repetitive motions;

c) an adjustment apparatus comprising a housing;

d) a locking apparatus positioned within the housing and capable of being configured in a locked state and an unlocked state; and e) a handle section connected to the elastomeric band and configured to transmit the force to the elastomeric band; wherein:

the elastomeric band comprises a first end; and a second end secured to the housing so that the elastomeric band extends away from the housing;

the elastomeric band is configured to return to the housing and enter the housing at a first location along a length of the elastomeric band so that a lengthwise portion of the elastomeric band located between the second end of the elastomeric band and the first location along a length of the elastomeric band forms a loop;

the elastomeric band is further configured to pass through the housing and exit the housing at a second location along the length of the elastomeric band;

the handle section is connected to the elastomeric band by way of the loop;

the locking apparatus is configured to secure the elastomeric band in relation to the housing when the locking apparatus is in the locked state; and the locking apparatus is further configured to permit the elastomeric band to move through the housing when the locking apparatus is in the unlocked state so as to change the first and second locations at which the elastomeric band respectively enters and exits the housing and thereby vary a size of the loop.

2. The device according to claim 1, wherein the electrical monitoring element comprises one or more sensors suitable to measure user/exerciser parameters.

3. The device according to claim 2, wherein the user/exerciser parameters include heart rate and calories burnt.

4. The device according to claim 1, wherein the electrical monitoring element comprises one or more sensors suitable to measure exercise parameters.

5. The device according to claim 4, wherein the exercise parameters include iterations and strength exerted on the elastomeric band.

6. The device according to claim 4, wherein the one or more sensors are selected from the group consisting of accelerometer, gyroscope, thermometer, or combination thereof.

7. The device according to claim 1, wherein the electrical monitoring element comprises a transmitting element for wirelessly transmitting the measured information to a remote device.

8. The device according to claim 1, further comprising an anchoring arrangement for attaching the first end of the elastomeric band to an anchor; wherein:

the handle section comprises the electrical monitoring element and a band reverting element; and the length of said elastomeric band runs from its first end that is fixedly attached to the anchoring arrangement, through the housing of the adjusting apparatus, along the band reverting element and back to the housing of the adjusting apparatus to which the second end thereof is fixedly attached.

9. A device according to claim 8, wherein the anchoring arrangement comprises an anchoring portion to which the first end of the elastomeric band is connected; and a connection portion for connecting the anchoring arrangement to an object.

10. A device according to claim 8, wherein the handle section further comprises:

I) a bracelet belt for connecting the handle section to a body part; and

II) a mediating element connecting the band reverting element to the bracelet belt.

11. A device according to claim 1, wherein the electrical monitoring element comprises:

a) a rechargeable power source;

b) a processing unit; and c) a user interface unit for receiving local input and displaying information regarding measured information and other information.

12. A device according to claim 8, wherein:

the adjusting apparatus comprises:

a) an opening in a wall of a first side of the housing of the adjusting apparatus; and b) two openings in a wall of a second side of the housing of the adjusting apparatus, the second side opposite to the first side, a first one of the two openings parallel to the opening in the wall of the first side of the housing of the adjusting apparatus;

the locking apparatus comprises a moveable member, a stationary member, a spring and an actuator; and a portion of the elastomeric band passes through the opening in the wall of the first side, between the moveable and stationary members, and through the first one of the two openings, such that when the actuator is released the moveable member is forced towards the stationary member by the spring thereby locking the elastomeric band in place, and such that when the actuator is pressed upon the moveable member is forced away from the stationary member and the elastomeric band is unlocked; and wherein the second end of the elastomeric band passes through the second opening in the wall of the second side, and is fixedly attached thereto.

* * * * *